US005711688A

United States Patent [19]

Matsunaga et al.

[11] Patent Number: 5,711,688

[45] Date of Patent: Jan. 27, 1998

[54] BATTERY TERMINAL

[75] Inventors: Hideki Matsunaga; Mitsugu Furutani, both of Yokkaichi, Japan

[73] Assignee: Sumitomo Wiring Systems, Ltd., Yokkaichi, Japan

[21] Appl. No.: 637,085

[22] Filed: Apr. 24, 1996

[30] Foreign Application Priority Data

May 12, 1995 [JP] Japan ..... 7-138592
May 16, 1995 [JP] Japan ..... 7-142584

[51] Int. Cl.[6] ..... H01R 4/42

[52] U.S. Cl. ..... 439/762; 439/763; 439/764

[58] Field of Search ..... 439/762, 763, 439/764, 759

[56] References Cited

U.S. PATENT DOCUMENTS 3,568,138 3/1971 Bakker ..... 439/762 OR
4,354,726 10/1982 Kato et al. .
5,087,214 2/1992 Dewar ..... 439/762 OR
5,498,178 3/1996 Tabata ..... 439/762 OR
5,558,545 9/1996 Staab et al. ..... 439/762 OR

FOREIGN PATENT DOCUMENTS 1 790 049 11/1971 Germany .
U-56-21366 2/1981 Japan .

*Primary Examiner*—P. Austin Bradley
*Assistant Examiner*—Daniel Witttels
*Attorney, Agent, or Firm*—Oliff & Berridge, P.L.C.

[57] ABSTRACT

The electrode holding portion is formed of band metal bent round into an annular shape, and a pair of lugs are formed at the ends of the holding portion. At the free end of one lug, a stopper is formed by being squarely bent toward the facing lug. Additionally, beside the flanges formed protruding outward from the top rim ranging from the electrode holding portion to the lugs and also along the bottom rim of the lug, reinforcement pieces are formed along the top and bottom rims of the stopper continuously respectively ranging from the flanges. Since deformation of the stopper is prevented by the reinforcement pieces, the deformation of the electrode holding portion due to excessive diametric reduction is surely prevented.

10 Claims, 6 Drawing Sheets

BATTERY TERMINAL

BACKGROUND OF THE INVENTION

The present invention relates to a battery terminal used for connecting an electric cable to the electrode of a battery mounted on such as an automobile.

FIG. 1 shows a conventional battery terminal of this type, where an electrode holding portion 31 is formed by bending round band metal while a pair of lugs 32 and 33 are formed by extending both ends of it so as face to each other. A crimp barrel 35 for connection of an electric cable 34 is formed as a part of the lug 32 while a stopper 36, which can come into contact with the facing lug 32 when the free end is bent squarely, is formed as a part of the other lug 33, and matching bolt holes are formed in both lugs 32 and 33.

After the electrode holding portion 31 is fitted to an electrode P protruding from a battery B, the lugs 32 and 33 are drawn near to each other to result with diametric reduction of the electrode holding portion 31 when a bolt 37 which is inserted through the bolt holes and a nut 38 which is fitted on its end by screw thread are tightened, and thus contact is made by the electrode holding portion pressed against the outer cylindrical surface of the electrode P. An excessive tightening of the terminal is restricted by the stopper 36 on contacting the facing lug 32.

The structure of the conventional one, however, receives tightening force with one stopper 36 and the electrode P is made of lead which is a comparatively soft material, and thus the slipping and flat deformation of the tip of the stopper 36 over the lug 32 as in FIG. 2 after the stopper 36 has come into contact with the lug 32 would occur to result with the excessive tightening of the terminal by the electrode holding portion 31 deepening the engagement with the electrode P. This may result not only in excessive deformation of the terminal beyond its elastic limit which can cause a failure in availability of the appropriate holding force at such repetitive use of the terminal as reattachment of the terminal to the electrode P after removal, but also cracks starting from the deformed part.

The band metal forming the electrode holding portion and the lugs is cut out from base material of thin metal plate by stamping. When allocating the stamping patterns on the material, the above-described structure where the flanges function as the bolt rotation stopper has a demerit because some extra material for the flanges is required on both sides of each band metal pattern, which results with wasteful pattern allocation on the material and increases the cost.

SUMMARY OF THE INVENTION

An object of the present invention which has been accomplished under such circumstances as described above is to effectively prevent excessive deformation of the battery terminal.

Another object of the present invention is to form the bolt rotation stopper at low cost.

To achieve an object as described above, the present invention provides a battery terminal which comprises an electrode holding portion formed by bending band metal round into an annular shape, a pair of lugs extended outward from both ends of the electrode holding portion so as to face each other and a bolt to be fitted between the two lugs and of which the electrode holding portion is deformed so as to reduce the diameter through displacement of the pair of lugs in such directions as the pair of lugs are drawn near to each other by the tightening of the bolt so that the electrode holding portion is pressed against the battery electrode fitted to the inside. In the battery terminal, a stopper to restrict the displacement of both of the lugs drawn near is formed by bending a free end of one of the lugs toward the other of the lugs so as to come into contact with the other of the lugs when the bolt is tightened, while reinforcement pieces for the maintenance of shape of the stopper by being formed as a single solid body ranging from one of the lugs to the stopper are also provided. The reinforcement pieces may be the flanges formed by bending both edges of one of the lugs.

In the invention described above, the stopper comes into contact with the facing lug when the bolt is tightened for a regulated amount to terminate tightening. If the bolt is tried to be tightened further, the tightening force acts on the stopper but the stopper will not be easily deformed by the tightening force since the stopper which is provided with reinforcement pieces is always maintained in a certain shape, and thus the excessive deformation of the electrode holding portion by diametric reduction is prevented.

The battery terminal according to the present invention is effective in ensured prevention of the excessive deformation of the electrode holding portion due to diametric reduction since the reinforcement pieces ranging from the lugs to the stopper are provided and thus the elasticity is maintained continuously even in repetitive use of the terminal and is also effective in ensured prevention of the deformation becoming a cause of such as cracks.

Further, the present invention provides a battery terminal which comprises an electrode holding portion formed by bending band metal round into an annular shape, a pair of lugs extended outward from both ends of the electrode holding portion so as to face each other and a bolt to be fitted between the two lugs and of which the electrode holding portion is deformed so as to reduce the diameter through displacement of the pair of lugs in such directions as the pair of lugs are drawn near to each other by the tightening of the bolt so that the electrode holding portion is pressed against the battery electrode fitted to the inside. In the battery terminal, a rotation stopper to restrict the rotation of the bolt is formed by swelling or caving the first lug.

The rotation stopper provided on the first lug formed by swelling toward the second lug which faces the first lug may function also as a stopper to restrict displacement of both lugs in approach by coming into contact with the second lug when the bolt is tightened.

A tubular burr formed on the second lug by extending the rim of the bolt hole for insertion of the bolt toward the first lug may be able to restrict the displacement of both lugs in approach by coming into contact with the first lug or with the rotation stopper when the bolt is tightened.

In the invention, the rotation stopper to restrict the rotation of the bolt can perform this function when the bolt head fits and engages with the rotation stopper. The rotation stopper is formed by swelling or caving a part of the lug and thus there is no need to retain any extra material for the rotation stoppers except for the electrode holding portions and lugs when allocating the stamping patterns on the metal plate.

Further, both the lugs are displaced in such directions as they approach each other when the bolt is tightened and then the tightening of the bolt is stopped by the swelled rotation stopper coming into contact with the other lug when the prescribed amount is displaced. That is, the rotation stopper prevents the electrode holding portion from being excessively deformed by diametric reduction.

Furthermore, a tubular burr is formed on the rim of the bolt hole by such method as folding the material having been in the position of the bolt hole toward the first lug when the bolt hole is formed. When the bolt is tightened, the two lugs are displaced in the directions approaching to each other, and then the tightening is stopped by the tubular burr coming into contact with the first lug or the rotation stopper when the prescribed amount is displaced. This prevents the electrode holding portion from being excessively deformed by diametric reduction.

According to the invention, extra material retainment for the rotation stopper is saved so that it is effective in low-cost formation of the bolt rotation stopper in comparison with the rotation stopper utilizing the flanges.

The rotation stopper prevents the electrode holding portion from being excessively deformed by diametric reduction and because there is no need formation of a special stopper with such a function as above, further cost reduction is achieved.

The tubular burr which is integrally formed on formation of the bolt hole prevents the electrode holding portion from being excessively deformed by diametric reduction, saves extra material retainment for prevention of the excessive deformation and surely prevents the excessive deformation of the electrode holding portion without cost increase. This is effective especially in the case where the cavity functioning as the rotation stopper is too shallow to function simultaneously as the stopper to restrict the displacement.

DETAILED DESCRIPTION OF THE PREFERRED EMBODIMENTS

First Embodiment

With reference to FIGS. 3 through 7, a first embodiment of the present invention related to the battery terminal will be described hereinafter.

Figure 1:
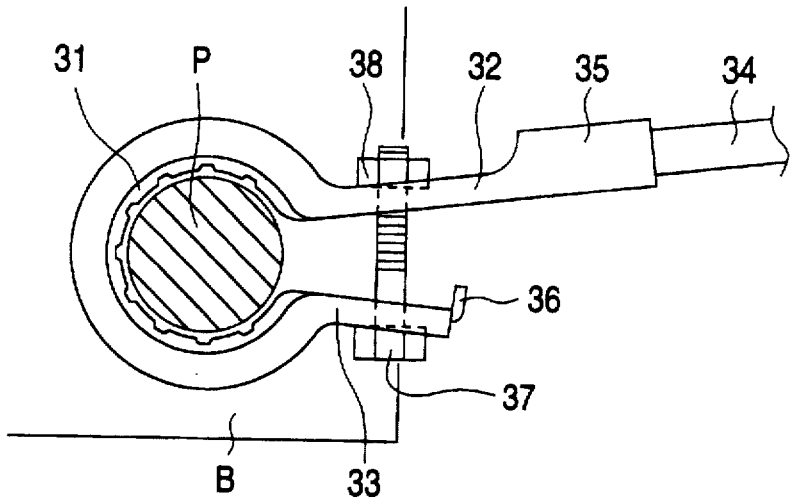
FIG. 1 (Related Art)
FIG. 1 is a plan partly showing a conventional product in the state before tightening.
Figure 2:
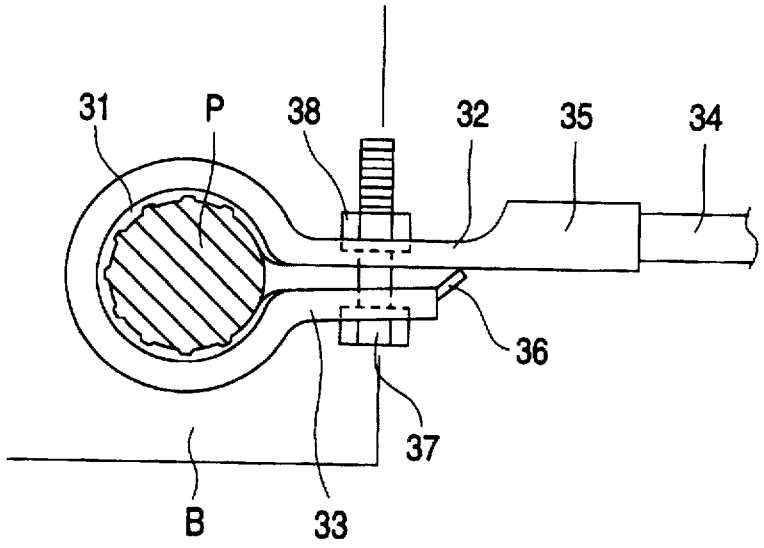
FIG. 2 (Related Art)
FIG. 2 is a plan showing the conventional product of FIG. 1 in the state of excessive tightening.
Figure 3:
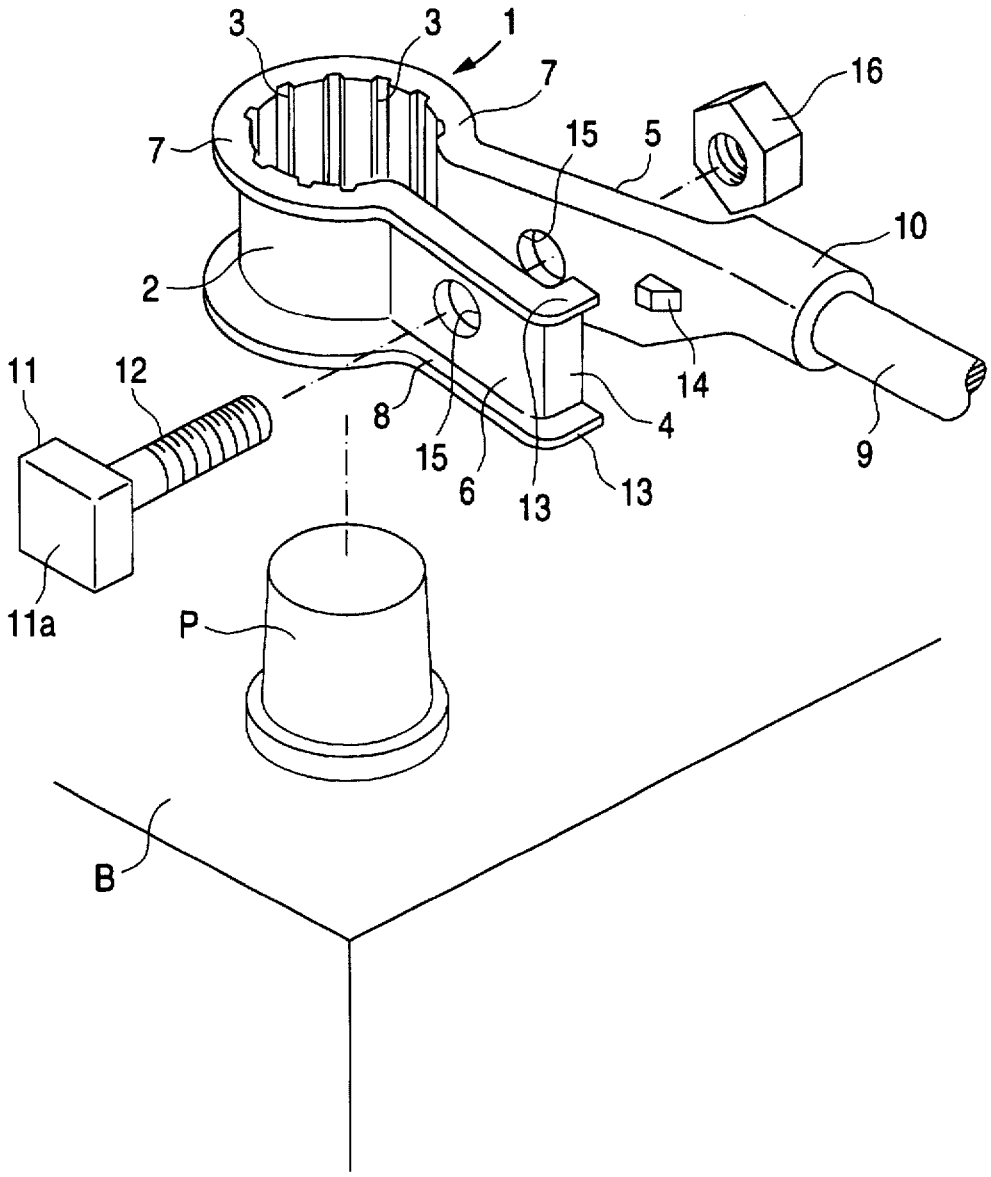
FIG. 3 is a perspective view entirely showing the first embodiment of the present invention.

An electrode P in FIG. 3 protruding from a battery B to be mounted on such as an automobile is made of lead and formed in a taper cylinder shape of which the diameter is gradually reduced toward the top.

A battery terminal 1 of this embodiment is made of electricity-conductive metal band as the base material which, bent round at its longitudinal center into an annular shape, forms an electrode holding portion 2 to be fitted in the electrode P. The electrode holding portion 2 matching the outer shape of the electrode P is also formed in a taper cylinder shape of which the diameter is gradually reduced toward the top. A plurality of vertical engagement grooves 3 are formed at regular intervals in circumferential direction on the inner cylindrical surface of the electrode holding portion 2. The function of the engagement grooves 3 running from the bottom rim to the top rim is to bite at the outer cylindrical surface of the electrode P.

A pair of lugs 5 and 6 are extended outward from either end of the electrode holding portion 2 so as to face to each other. A crimp barrel 10 for connection to the end of the electric cable 9 is formed at the protruding end of the lug 5 of the pair of the lugs 5 and 6. Matching bolt holes 15 for insertion of the shaft part 12 of the tightening bolt 11 run through both of the lugs 5 and 6. The electrode holding portion 2 is formed so as to open in a diameter capable of fitting to the electrode P with some clearance in natural conditions and so as to deform elastically by diametric reduction when both of the lugs 5 and 6 are displaced in the directions they are drawn near to each other.

Flanges 7 and 8 formed by squarely bending both top and bottom edges of the band metal outward are provided on both of the edges ranging from the electrode holding portion 2 to the lugs 5 and 6. The flanges 7 and 8 are designed for maintenance of a certain shape of the electrode holding portion 2, functioning against deformation of diametric reduction. Two parallel surfaces of a head 11*a* of the bolt 11 will function to stop the rotation of the bolt 11 when fitted between the flanges 7 and 8 formed on the top and bottom rims of the lug 6. Formation of the flanges 7 and/or 8 at either or both rims of the electrode holding portion 2 may be omitted.

In this embodiment, a stopper 4 is provided at the end of the lug 6 which is on the side opposite to the lug 5 where crimp barrel 10 is provided. The stopper 4 is formed by bending the band metal extending from the end of the lug 6 inward and almost squarely. The protruding length of the stopper 4 is designed so that the stopper 4 will come into contact with the facing lug 5 simultaneously at diametric reduction for the regulated amount of shallow engagement of the electrode holding portion squeezing the electrode P when the electrode holding portion 2 is deformed by diametric reduction caused by the lugs 5 and 6 drawn near to each other. Reinforcement pieces 13 are formed on the top and bottom rims of the stopper 4. The reinforcement pieces 13 bent outward almost squarely are formed as a single solid body ranging from the flanges 7 and 8 of lugs 5 and 6. When the two edges of the band metal are bent for formation of the flanges 7 and 8, the stopper 4 is simultaneously bent at its top and bottom and then bent at its end to form the single solid body integrated to the flanges 7 and 8. A restrict projection 14 is formed by hammering into the shape just outside the position where the inner surface of the lug 5 comes into contact with the free end of the stopper 4. The free end of the stopper 4 coming into contact with this restrict projection 14 from the direction of the electrode holding portion 2 prevents the stopper 4 from slipping over the inner surface of the lug 5 and causing flat deformation.

Operations of the first embodiment are described as follows.

When connecting to the electrode P, an end of the electric cable 9 is connected to the crimp barrel 10 and, after the shaft 12 of the bolt is inserted from the outer surface of the lug 6 where the stopper 4 is provided through the bolt holes 15 in the lugs 5 and 6, the nut 16 is temporarily assembled by fitting the screw thread at the tip of the shaft 12 which protrudes from the lug 5 on the other side. At this time, the two parallel surfaces of the head 11*a* of the bolt 11 are fitted between the upper and lower flanges 7 and 8 to stop the rotation of the bolt 11.

Figure 4:
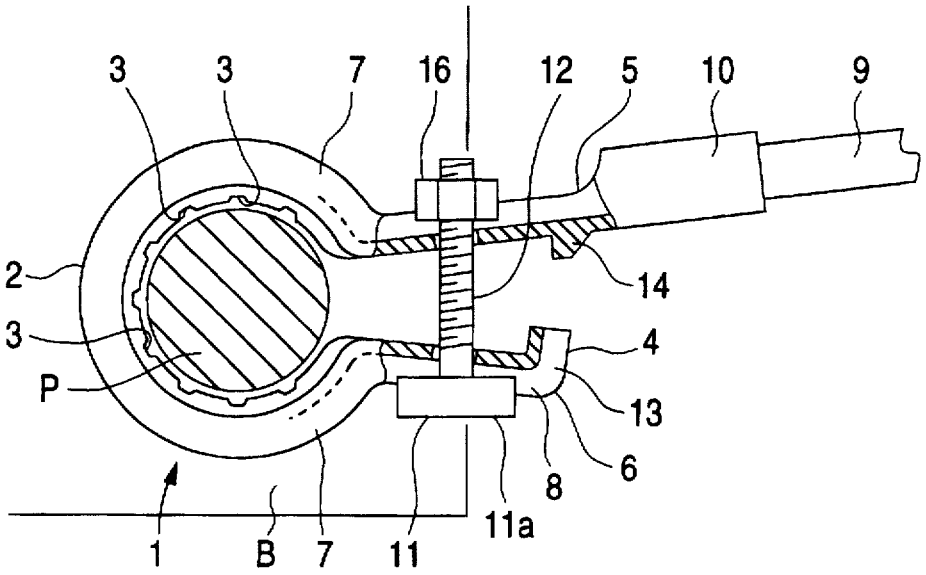
FIG. 4 is a plan partly showing the internal structure in the state before the bolt and the nuts are tightened.

Next, as in FIG. 4, the electrode holding portion 2 of the battery terminal 1 where the bolt 11 and the nut 16 are temporarily assembled is fitted to the electrode P of the battery B and then the bolt 11 and the nut 16 are tightened with a torque wrench. Displacement of the lugs 5 and 6 in the directions so as to be drawn to each other by the tightening causes gradual diametric reduction of the electrode holding portion 2 and the further diametric reduction after having come to tight contact with the outer cylindrical surface of the electrode P securely connects the outer cylindrical surface of the electrode P being engaged with the engagement grooves 3 on the inner surface of the electrode holding portion 2 with some depth.

Figure 5:
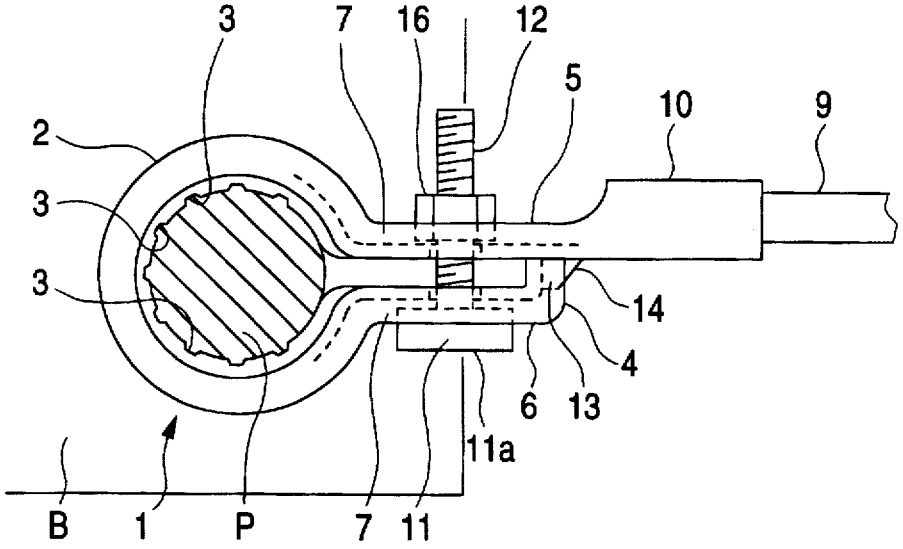
FIG. 5 is a plan showing the state after the bolt and the nuts are tightened.
Figure 6:
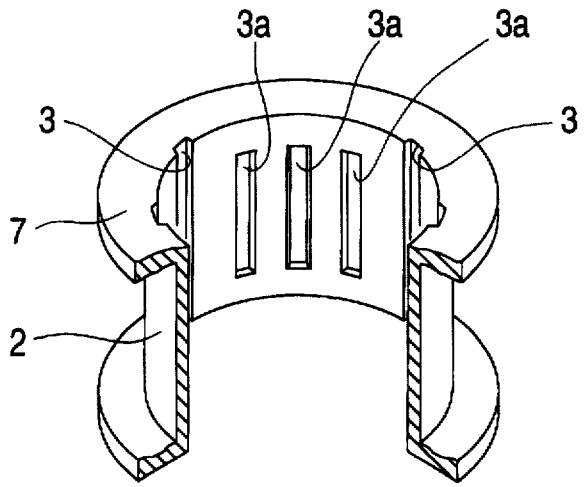
FIG. 6 is a partly cut-out perspective view of an alternative example where the electrode holding portion is modified.
Figure 7:
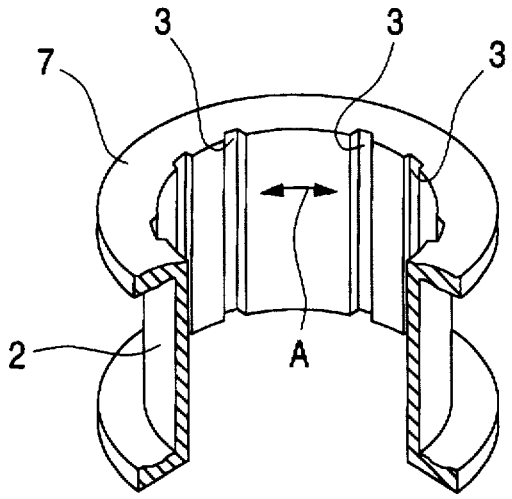
FIG. 7 is a partly cut-out perspective view of another alternative example where the electrode holding portion is modified.

A prescribed amount of diametric reduction of the electrode holding portion 2 results with the stopper coming into contact with the lug 5 which the stopper 4 faces, as in FIG. 5, and the tightening is stopped by a prescribed torque working on the torque wrench. If the bolt 11 should be tightened further, the tightening force would work on the stopper 4 but, since the stopper 4 is formed in a solid single body incorporating the reinforcement pieces 13 and the flanges 7 and 8, even a fairly large tightening force cannot deform the stopper 4. That is, after the stopper 4 has come into contact with the lug 5, the bolt 11 cannot be tightened further, and thus deformation of the electrode holding portion 2 by excessive diametric reduction is surely prevented. Even if the free end of the stopper 4 should slip over the lug 5, which might result with deformation, its contact with the restrict projection 14 provided in the vicinity of the contact position can stop the deformation. Especially in the case where the restrict projection 14 is provided, the deformation of the stopper 4 in the opening direction is prevented by the restrict projection 14 and the inward deformation of the lug 6 at the base of the stopper 4 by further tightening after the stopper 4 has come into contact with the restrict projection 14 is prevented by the solid single body incorporating the flanges 7 and 8 and the reinforcement pieces 13.

As described above, since this embodiment surely prevents deformation of the stopper 4, the electrode holding portion 2 cannot be deformed excessively by diametric reduction and thus elasticity is maintained continuously even in repetitive use of the battery terminal 1. Generation of such as cracks is prevented and thus the electrode P can be maintained properly.

The engagement grooves 3 are formed at regular intervals on the inner cylindrical surface of the electrode holding portion 2 so as to enhance contact degree by deepening the engagement with the electrode P. If any of the engagement grooves 3, however, is formed in a position where stress works most at the time of deformation by diametric reduction, cracks tend to start from the position even if deformation by diametric reduction has not occurred. Therefore, the structure may be such as no engagement grooves are formed in the central area of the inner cylindrical surface of the electrode holding portion 2, where stress works most when deformed by diametric reduction as in FIG. 7 (the area A in the figure, which is in the symmetric position opposite to the position where lugs 5 and 6 are provided). As in FIG. 6, an alternative structure may be such as the engagement grooves formed shorter only in this area (engagement grooves 3*a* in the figure) so as to prevent cracks. However, if all of the engagement grooves are made shorter in the entire area, the sufficient holding force cannot be provided.

The present invention is not confined to the embodiment described above but such embodiment as follows is also within the technical scope of the invention and, beside the following, other embodiments with a variety of changes within the scope of the present invention are also possible:

Although the reinforcement pieces 13 are formed respectively on both the top and bottom rims of the stopper 4 in the embodiment described above, it may be formed on either of the rims. As another alternative, instead of forming the reinforcement pieces 13 continuously extended from the flanges 7 and 8, a rib shape which is stamped along the longitudinal center line of the lug 6, for example, may be extended continuously to the side of the stopper; in any way, what is essential is a reinforcement means continuously provided from the lug 6 to the stopper 4 and its shape or method does not matter.

Although a restrict projection 14 is provided on the lug 5 which faces the stopper 4, deformation of the stopper 4 may be prevented only with the reinforcement piece without provision of the restrict projection.

Second Embodiment

Figure 8:
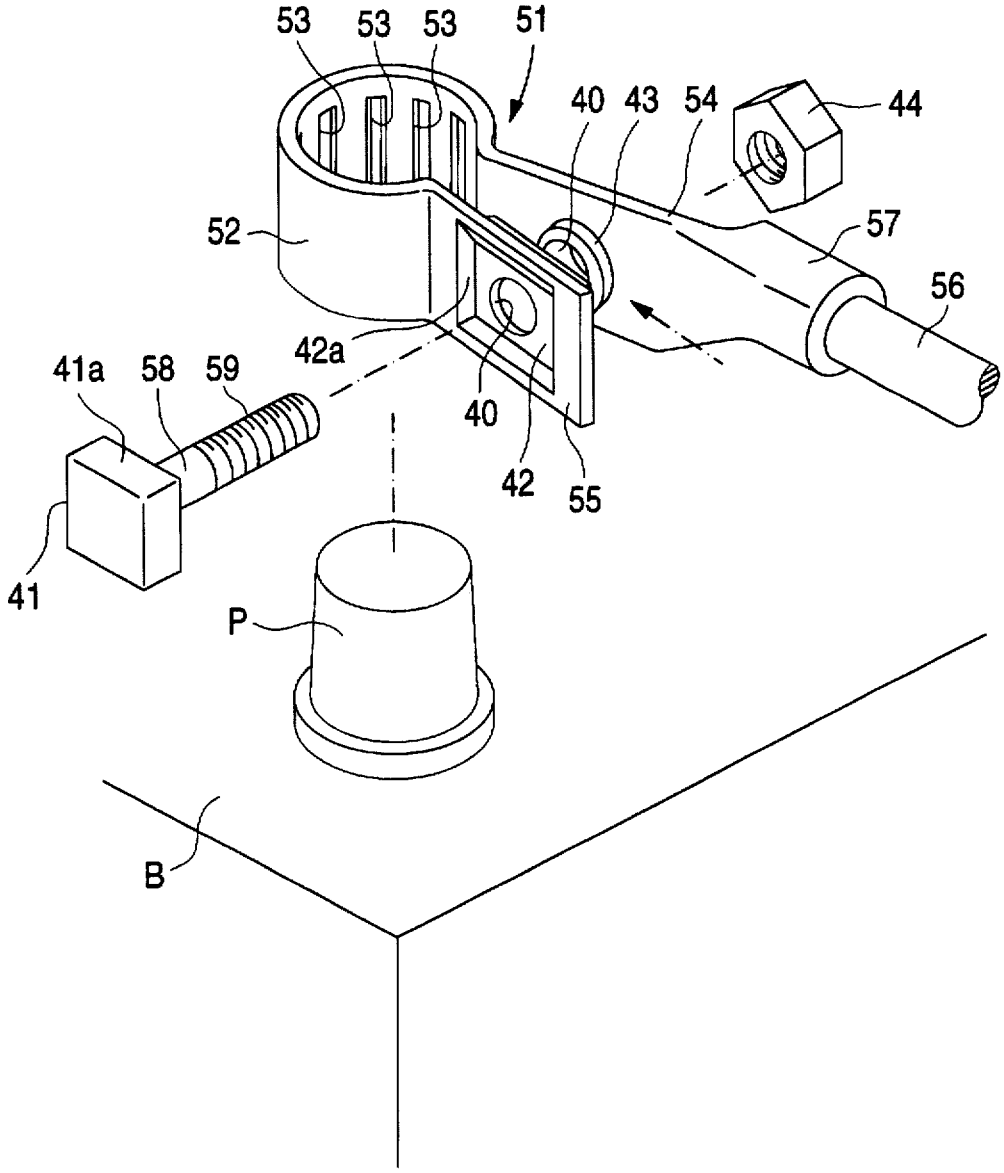
FIG. 8 is a perspective view entirely showing the second embodiment of the present invention.
Figure 9:
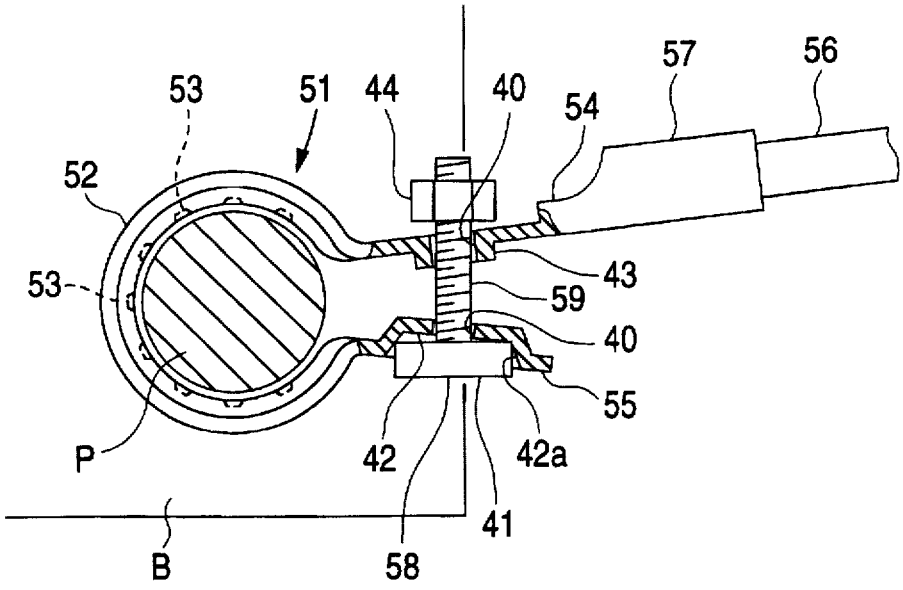
FIG. 9 is a plan partly showing the internal structure in the state before the bolt and the nuts are tightened.
Figure 10:
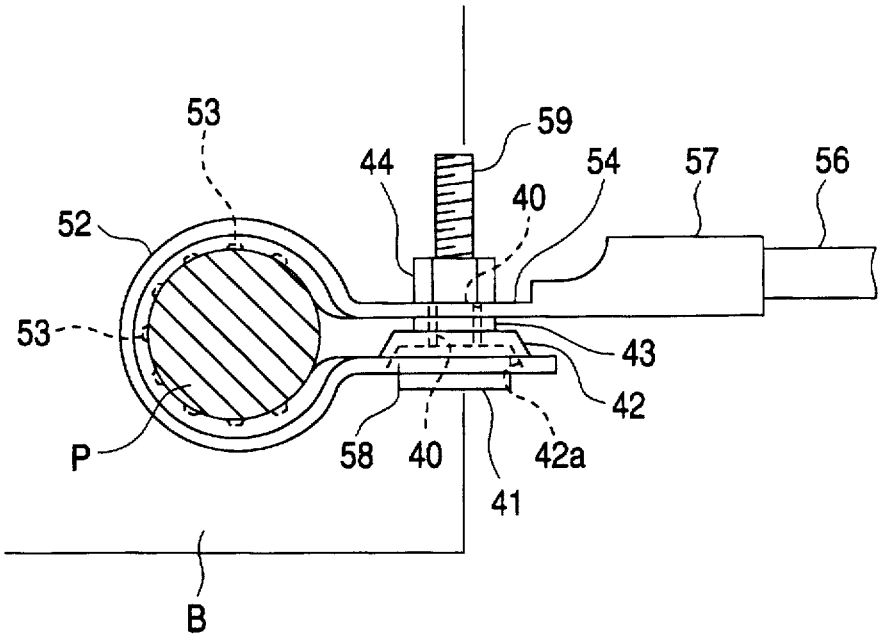
FIG. 10 is a plan showing the state after the bolt and the nuts are tightened.

With reference to FIGS. 8 through 10, a second embodiment of the present invention will be described hereinafter.

An electrode P in FIG. 8 protruding from a battery B to be mounted on such as an automobile is made of lead and formed in a taper cylinder shape of which the diameter is gradually reduced toward the top.

A battery terminal 51 of this embodiment comprises an electrode holding portion 52 to be fitted in the electrode P. The electrode holding portion 52 is formed by bending a piece of band metal, which is cut out from a sheet of electricity-conductive thin metal plate, round at its longitudinal center into an annular shape. The electrode holding portion 52 matching the outer shape of the electrode P is also formed in a taper cylinder shape of which the diameter is gradually reduced toward the top. A plurality of vertical engagement grooves 53 are formed at regular intervals in circumferential direction on the inner cylindrical surface of the electrode holding portion 52. The function of the engagement grooves 53 is to bite at the outer cylindrical surface of the electrode P. Neither the upper nor the lower end of each engagement groove 53 reaches neither the top nor the bottom rim of the electrode holding portion 52 to prevent generation of cracks possibly caused by decrease in the intensity of the engagement groove ends resulting from inclination to deformation of the electrode holding portion 52.

A pair of lugs 54 and 55 are extended outward from either end of the electrode holding portion 52 so as to face to each other. A crimp barrel 57 for connection to the end of the electric cable 56 is formed at the protruding end of the lug 54 of the pair of the lugs 54 and 55. Matching bolt holes 40 for insertion of the shaft part 59 of the tightening bolt 58 run through both of the lugs 54 and 55. The electrode holding portion 52 is formed so as to open in a diameter capable of fitting to the electrode P with some clearance in natural conditions and so as to deform elastically by diametric reduction when both of the lugs 54 and 55 are displaced in the directions they are drawn near to each other. The bolt 58 used here has a square head 41.

The area surrounding the bolt hole 40 in the lug 55 is caved in a square shape so as to form a rotation stopper 42.

The shape is formed by hammering the outer surface of the lug 55 from outside to inward, and the cavity is formed in the dimensions a little larger than the outer dimensions of the head 41 of the bolt 58. That is, the head 41 fits in the rotation stopper 42 when the bolt 58 is fully inserted into the bolt holes 40, where the outer edge surface 41*a* of the head 41 of the bolt 58 and the inner wall surface 42*a* of the rotation stopper 42 are engaged to stop the rotation.

A tubular burr 43 is formed by burring on the rim of the bolt hole 40 in the lug 54. The tubular burr 43 is formed by extruding the ring part of the band metal into a tubular shape, pressing the rim toward the lug 55, after the bolt hole 40 is formed. The tip of the tubular burr 43 coming into contact with the rotation stopper 42 formed on the lug 55 at the time of tightening prevents the lugs 54 and 55 from approaching to each other closer than the restrict amount. The length of the tubular burr is set up so as to restrict the distance between the lugs 54 and 55 and will allow some depth of engagement of the electrode holding portion 52 over the electrode P.

The followings describe the operation of the second embodiment.

The connection is made by connecting a free end of the cable 56 to the crimp barrel 57. The shaft part 59 of the bolt 58 is inserted into the bolt hole 40 from the outer side of the lug 55 where the rotation stopper 42 is provided and via the tubular burr 43 into the bolt hole 40 in the lug 54. While the head 41 of the bolt 8 is fitted in the rotation stopper 42, a nut 44 is temporarily assembled on the tip of the shaft 59 protruding from the lug 54 by fitting the screw thread.

Nextly, as in FIG. 9, the electrode holding portion 52 of the terminal 51 where the bolt 58 and the nut 44 are temporarily assembled is fitted on the electrode P of the battery B and then the nut 44 is tightened with a torque wrench. Since the outer edge surface 41*a* of the head 41 of the bolt 58 and the inner wall surface 42*a* of the rotation stopper 42 are engaged, the bolt 58 will not rotate and is tightened securely. The electrode holding portion 52 is gradually reduced in diameter when both the lugs 54 and 55 are displaced in the directions in which they approach each other by this tightening operation. Further diametric reduction after tight contact with the outer cylindrical surface of the electrode P is made secures the contact with some depth between the outer cylindrical surface of the electrode P and the engagement grooves 53 on the inner cylindrical surface of the electrode holding portion 52. After a prescribed amount of diametric reduction of the electrode holding portion 52, as in FIG. 10, the tip of the tubular burr 43 comes in contact with the rotation stopper 42 to restrict approach of both the lugs 54 and 55, and a certain torque working against the torque wrench stops tightening.

As described above, rotation of the bolt 58 is surely stopped with the rotation stopper 42 formed by caving a part of the lug 55 when the present embodiment is utilized. That is, since conventional flanges need not be formed, only the material for the electrode holding portion 52 and the lugs 54 and 55 are needed when allocating the stamping patterns on the base material of thin metal plate. Therefore, in comparison with the conventional products, this constitution of the rotation stopper for the bolt 58 is effective in cost reduction. In this embodiment where the tubular burr 43 is provided, the electrode holding portion 52 which will not be deformed excessively by diametric reduction retains its elasticity continuously even in repetitive use of the battery terminal 51 and thus the electrode P can be maintained properly. Moreover, since the tubular burr 43 is formed on formation of the bolt hole 40 integrally with the material having been in the position of the hole, no extra material is needed to prevent excessive deformation of the electrode holding portion 52 and thus provision of the function as a stopper causes no increase in the cost.

Instead of forming the tubular burr 43, the electrode holding portion 52 may be prevented from excessive deformation caused by diametric reduction with increase in the dimensions of the cavity of the rotation stopper 42 so that the rotation stopper 42 will come into direct contact with the lug 54. In this case, since the tightening force working on the bolt 58 is received by the entire area of the bottom (the area in contact with the lug 54) of the rotation stopper 42, excessive deformation is surely prevented with less inclination to deformation in comparison with a conventional stopper formed by simply bending the tip of the lug as described above.

The present invention is not confined to the embodiment described above but such embodiment as follows is also within the technical scope of the invention and, beside the following, other embodiments with a variety of changes within the scope of the present invention are also possible:

In stead of the square head 41 in the embodiment described above, the bolt 58 may have such as a hexagonal head if the configuration of the cavity of the rotation stopper matches the configuration of the head, such as hexagon.

Although the rotation stopper 42 in the embodiment described above is formed by caving the surrounding area of the bolt hole 40 along the head 41 of the bolt 58, an alternative one may be formed by swelling the surrounding area of the bolt hole so as to wall the bolt head.

Another alternative rotation stopper may restrict the bolt rotation with a part of the lug swelled so as to engage with one side of the bolt head.

What is claimed is:

1. A battery terminal comprising:

an electrode holding portion formed by bending band metal round into an annular shape;

a pair of first and second lugs extended outward from both ends of said electrode holding portion so as to face each other; and a bolt to be fitted between the two lugs;

wherein said electrode holding portion is deformed so as to reduce the diameter through displacement of said pair of lugs in a direction to be closed to each other by the tightening of said bolt so that said electrode holding portion is pressed against the battery electrode, said battery terminal further comprising:

a stopper to restrict the displacement of both of said lugs, said stopper being formed by bending a free end of said first lugs toward said second lugs so as to come into contact with said second lugs when said bolt is tightened; and a reinforcement piece for maintaining shape of said stopper ranging from said lug to said stopper.

2. A battery terminal as claimed in claim 1, wherein said reinforcement piece is a flange formed by bending an edge of said first lug.

3. A battery terminal as claimed in claim 2, wherein a further reinforcement piece is formed at the other end of the first lug.

4. A battery terminal as claimed in claim 1, wherein said electrode holding portion has a plurality of engagement grooves on an inner cylindrical surface thereof.

5. A battery terminal as claimed in claim 4, wherein said electrode holding portion has no engagement groove in a center area of the inner cylindrical surface at where stress is applied when the electrode holding portion is deformed.

6. A battery terminal comprising:

an electrode holding portion formed by bending band metal round into an annular shape;

a pair of first and second lugs extended outward from both ends of said electrode holding portion so as to face each other; and a bolt to be fitted between the two lugs;

wherein said electrode holding portion is deformed so as to reduce the diameter through displacement of said pair of lugs in a direction to be closed to each other by the tightening of said bolt so that said electrode holding portion is pressed against the battery electrode, said battery terminal further comprising:

a rotation stopper to restrict the rotation of said bolt, said rotation stopper being formed on the first lug providing a caved area around the bolt thereby forming a complementary receiving area for the head of said bolt.

7. A battery terminal as claimed in claim 6, wherein said rotation stopper provided on said first lug is formed by swelling toward the second lug which faces said first lug, said stopper restricting displacement of both lugs in approach by coming into contact with said second lug when said bolt is tightened.

8. A battery terminal as claimed in claim 6, wherein a tubular burr is formed on said second lug by extending the rim of bolt hole for insertion of said bolt toward said first lug, said tubular burr restricting displacement of both lugs in approach by coming into contact with one of said first lug with said rotation stopper when said bolt is tightened.

9. A battery terminal as claimed in claim 6, wherein said electrode holding portion has a plurality of engagement grooves on an inner cylindrical surface thereof.

10. A battery terminal as claimed in claim 6, wherein said electrode holding portion has no engagement groove in a center area of the inner cylindrical surface at where stress is applied when the electrode holding portion is deformed.

* * * * *